United States Patent [19]

Hartman, Jr.

[11] 4,113,235

[45] Sep. 12, 1978

[54] LEVER-ACTION LIFT JACK

[76] Inventor: Wilbert Hartman, Jr., 2774 S. Pierce St., Denver, Colo. 80227

[21] Appl. No.: 825,680

[22] Filed: Aug. 18, 1977

[51] Int. Cl.[2] ..... B66F 7/22

[52] U.S. Cl. ..... 254/131

[58] Field of Search ..... 254/8 R, 131, 94; 214/373, 340, 1 D; 280/293; 211/22, 17; 248/352

[56] References Cited

U.S. PATENT DOCUMENTS

| | | | |
|---|---|---|---|
| 2,555,471 | 6/1951 | Chambers | 254/94 |
| 2,782,947 | 2/1957 | Linsel | 214/373 |
| 3,667,728 | 6/1972 | Garelich | 254/8 R |
| 3,761,058 | 9/1973 | Stone et al. | 254/94 |

FOREIGN PATENT DOCUMENTS

| | | | |
|---|---|---|---|
| 818,010 | 8/1951 | Fed. Rep. of Germany | 280/293 |

*Primary Examiner*—Robert C. Watson
*Attorney, Agent, or Firm*—Ancel W. Lewis, Jr.

[57] ABSTRACT

A lever-action jack has a cross-support and a pair of lever assemblies at opposite ends thereof. Each lever assembly is laterally outside the vehicle supported for lateral stability and positions the cross-support between the ends of and in spaced relation to a base portion defining a force arm that is turned in a lever action about a fulcrum at one end of the base portion, preferably by a handle releasably secured to one end of one of the base portions, to raise and lower the cross-support. A stand portion is connected between the base portion and cross-support and locates the cross-support between the ends of the base portion so there is a length of the base portion on each side of the cross-support to counteract loading forces on the cross-support that tend to tip the jack forwardly or rearwardly.

11 Claims, 6 Drawing Figures

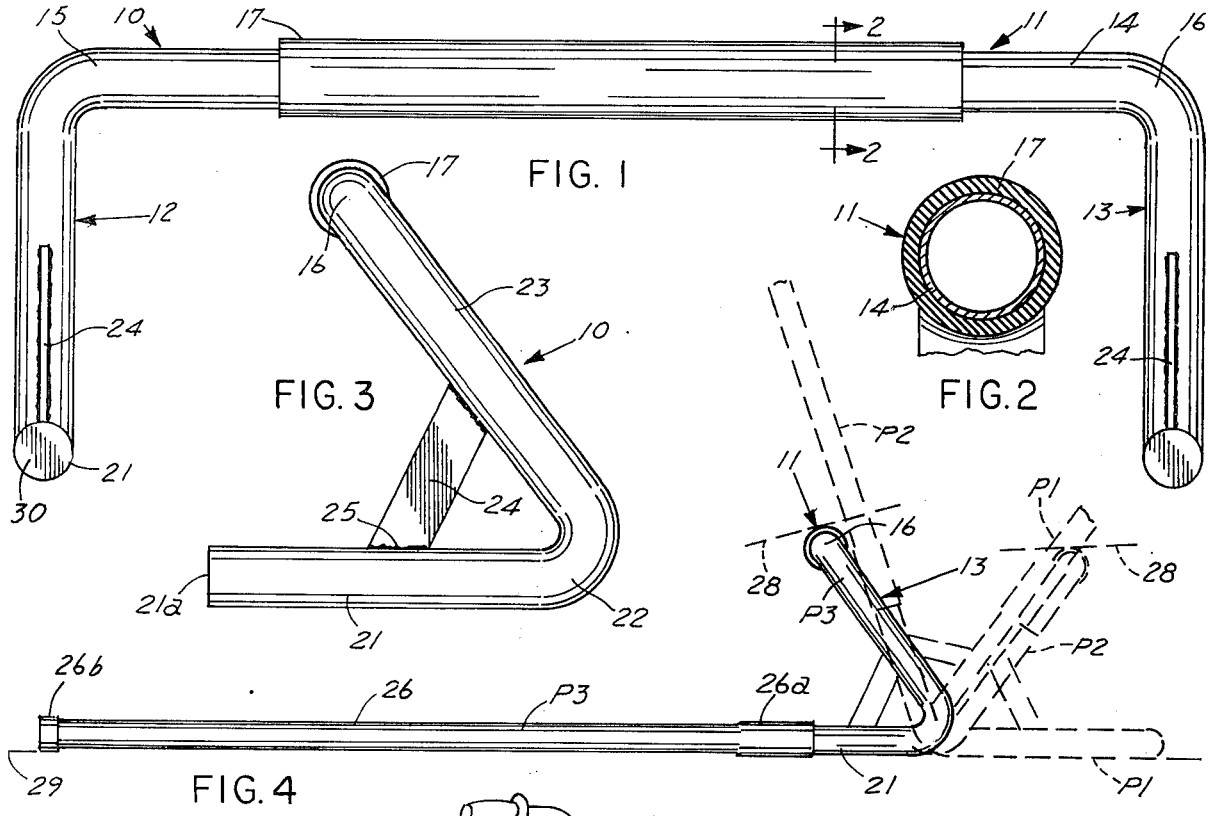
15
10
17
2
11
14
16
12
24
21
30
FIG. 1
17
16
23
10
FIG. 3
25
24
21a
21
22
17
11
13
14
24
FIG. 2
P2
11
16
P1
28
13
28
P3
P2
26b
26
P3
26a
29
21
P1
FIG. 4
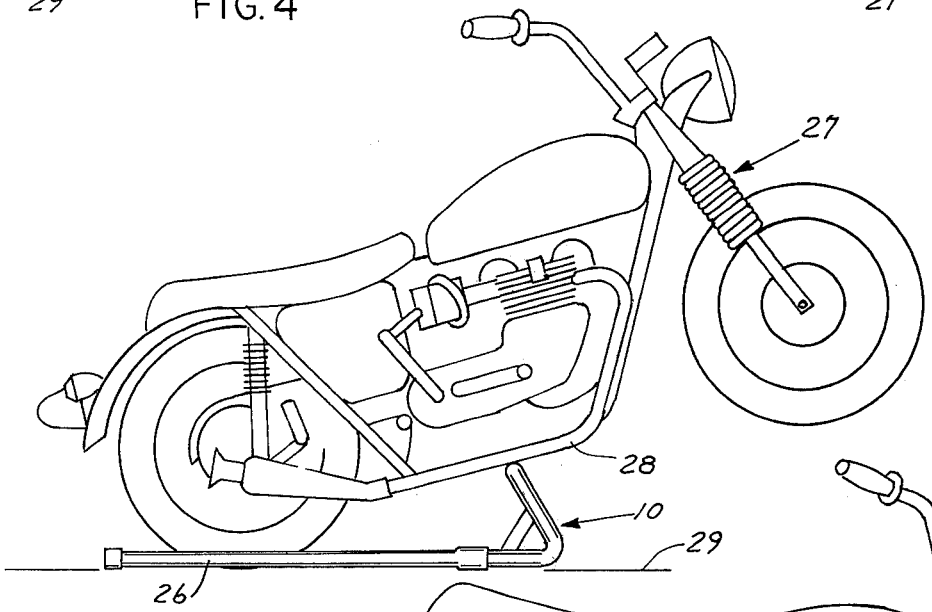
27
FIG. 5
28
10
29
26
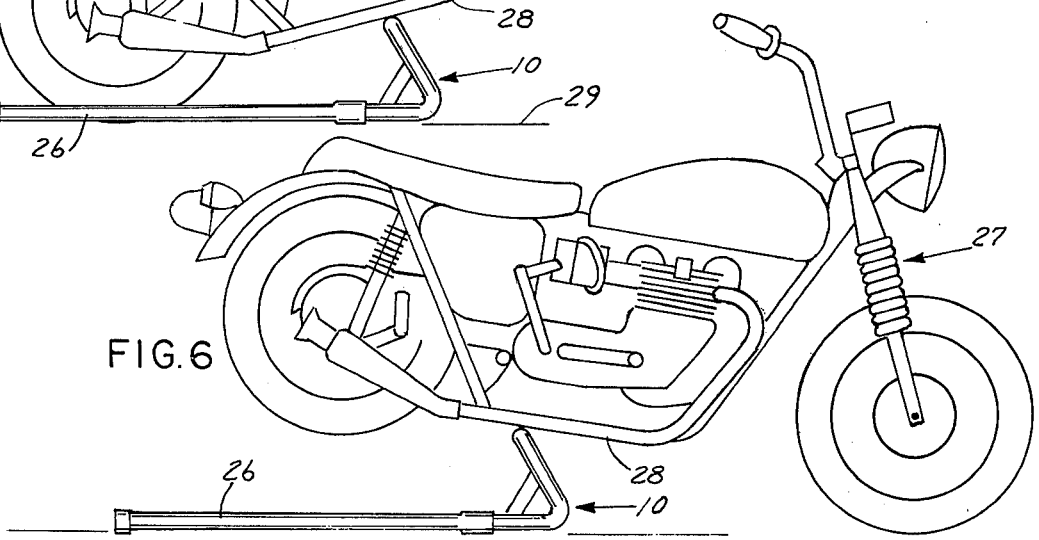
27
FIG. 6
26
28
10

LEVER-ACTION LIFT JACK

FIELD OF THE INVENTION

This invention in general relates to lifting and support devices for vehicles and more particularly to a novel lever-action lift jack that is particularly suitable for raising and supporting motorized bikes, motorcycles and the like.

BACKGROUND OF THE INVENTION

In recent years there has been a substantial increase in the number and types of two-wheeled motorized vehicles in use. There are many instances in which it is desirable and necessary to lift or raise a two-wheeled motorized vehicle off the ground. In the past this has generally been done manually, without any mechanical advantage, using boxes of blocks. Attempts have also been made to use mechanical or hydraulic automobile jacks but these are not designed to support two-wheeled vehicles in a stable manner. A particular difficulty in supporting such vehicles is their tendency to tilt laterally or forwardly or rearwardly.

Accordingly, an object of the present invention is to provide a simple, durable, highly stable and easy to use jack for lifting and supporting a two-wheeled motorized vehicle.

Another object of the present invention is to provide a lift jack with no mechanically moving parts that uses a lever action characterized by a considerable mechanical advantage and considerable lateral stability thereby allowing one person to readily lift the motorcycle to a raised position and have the vehicle remain in that raised position.

Yet a further object of the present invention is to provide a novel lever-action-type jack that supports a wide variety of two-wheeled vehicles in a stable condition in the raised position characterized by a tubular cross-support in turn supported at the ends by identical tubular lever arms that dispose the cross-support to avoid front and rear tipping and provide effective lever action to raise and lower a load.

SUMMARY OF THE INVENTION

A jack particularly suited for lifting and supporting two-wheeled motorized vehicles has a cross-support connected at the ends to a pair of identical lever assemblies that is raised by manipultion of one of the lever assemblies from a lowered position to a raised position and back to a lowered position in a lever-action movement. A preferred construction disclosed is a unitary, metal, tubular body having a straight intermediate section provided with a vehicle-engaging friction surface extending substantially beyond the sides of the supported vehicle and a pair of end sections disposed perpendicular to the intermediate section. Each end section includes a straight base portion, a curved rocking portion at one end of each base portion opposite a free end of the base portion, and a turned-back portion connected by said rocking portion to one end of the base portion. To raise the intermediate section a turning force is applied at the free end of one of the base portions and the rocking portion turns in a rocking motion on a support surface in a lever action to rotate the intermediate section from a resting position on the supporting surface up and in contact with the vehicle and then to a center position of maximum height and back down to a slightly lower over-center support position. A handle section releasably fastens to the free end of either base portion to provide a longer lever arm for a greater mechanical advantage in raising the load and provides additional stabilization against forward or rear tilting in the raised position.

Other objects, advantages and capabilities of the present invention will become more apparent as the description proceeds, taken in conjunction with the accompanying drawings in which like parts have similar reference numerals and in which:

FIG. 1 is a rear elevational view of a lever-action jack, drawn to scale and one-fourth actual size, embodying features of the present invention;

FIG. 2 is a sectional view taken along lines 2—2 of FIG. 1;

FIG. 3 is a side elevational view of the jack shown in FIG. 1;

FIG. 4 is a side elevational view of the jack with the handle in place, the assembly being shown in full lines in the raised support position and with portions shown in dashed lines in an intermediate position initially engaging the vehicle and in the lowered position;

FIG. 5 is a side elevational view of the jack supporting a two-wheeled vehicle with the front wheel raised; and FIG. 6 is a side elevational view of the jack and handle assembly supporting a two-wheeled vehicle with the rear wheel raised.

Referring now to the drawings, the lever-action jack 10 shown, generally stated, has a horizontally disposed crossbar or cross-support 11 supported at the ends by a pair of oppositely disposed lever assemblies 12 and 13 that are connected to the ends of the cross-support 11 and extend in a generally perpendicular direction in relation thereto.

The jack 10 shown is constructed of a unitary, rigid, metal, tubular body that is shaped with a straight, transverse tubular section 14 on which there is telescoped in a friction fit a length of resilient, reinforced rubber tubing 17 providing a resilient friction surface for the transverse support 11 that serves to prevent the frame of the vehicle from slipping when a vehicle is raised and lowered in the manner described hereinafter. The tubular section 14 is connected at the ends to the lever assemblies 12 and 13 by right-angle curved portions 15 and 16, preferably formed by a bend in the tubular body, to dispose the lever assemblies at right angles to the tubular section 14.

Each of the lever assemblies 12 and 13 is symmetrically arranged relative to the center of the cross-support 11 and each lever assembly is of an identical construction so that a description of one applies to both. The length of the cross-support 11 is substantially greater than the width of the vehicle being supported to afford effective lateral stability.

Referring to assembly 13, there is shown a straight base portion 21 having a free end **21*a* and a curved rocking portion 22 at the opposite end that connects one end of the base portion 21 to a straight stand portion 23. The stand portion 23 extends at an acute inside angle from the curved rocking portion 22 back over the base portion to locate the cross-support between the ends of the base portion and preferably back beyond the midpoint or center of the base portion. This location for the cross-support 11 relative to the associated base portion 21 then provides a length of base portion on each side of the cross-support which serves to counteract loading forces tending to cause forward or rear tilting. A metal reinforcing strip 24 is welded at both ends along the inside angle, as indicated at 25, between portions 21 and 23 for added strength. A cap 30 is located in the free open end of base portions 21** to prevent same from filling with dirt and to eliminate a sharp edge.

A tubular handle 26 telescopes on a free end portion 21*a* of either of the base portions to provide a longer lever arm in the turning of the jack between the raised and lowered positions and provides additional support surface to stabilize the jack against tilting under load. This handle preferably is a length of metal tubing of the same diameter as the tubular body forming section 14 and the lift sections 12 and 13 and has an enlarged or swaged section 26*a* at one end that telescopes over the end portion 21*a* of either of the base portions and a cap 26*b* opposite swaged section 26*a*.

In use and operation of the above-described jack 10 the jack is initially placed in the lowered position designated by dashed lines P1 in FIG. 4. The jack may be placed forwardly of the front wheels of the two-wheeled vehicle represented at 27 and the front wheel rolled over the cross-support, or the jack may be slid through the space between the frame and front wheel. In the lowered position the cross-support 11 and stand portions 23 are disposed on a supporting surface indicated at 29. In this lowered position the base portions 21 and handle section 25 are generally upright but on a slight forward incline to the vertical.

A turning force is applied to the handle 25 to turn it downwardly and rearwardly toward the supporting surface 29. The curved rocking portion 22 turns on the supporting surface 29 defining a fulcrum about which the base and stand portions turn, with the force arm being along the handle and associated base portion. The cross-support 11 raises and the friction surface of member 17 engages the underside of the vehicle frame at a position designated P2. The jack is located to engage the frame or down-pipes of the vehicle either slightly in front of or slightly rearwardly of the balance point of the vehicle depending on whether the front or rear wheels are to be up. The cross-support 11 continues to rise to a position of maximum height, at which point the stand portions 23 are perpendicular to the supporting surface which is a center point, and then goes back down to an over-center support position wherein the weight of the vehicle is distributed across the base sections.

This jack will support a two-wheeled vehicle such as a motorcycle in a balanced position with the cross-support 11 slightly forwardly of the balance point tilted with the front wheel up and the rear wheel on the supporting surface as shown in FIG. 5 or with the cross-support slightly rearwardly of the balance point with the front wheel down and the rear wheel on the supporting surface as shown in FIG. 6.

In lowering the vehicle the handle and base portions are turned back in the reverse direction with the cross-support 11 first moving back up to a position of maximum height and then down to the lowered position P1.

In a preferred embodiment the tubular material is steel and of a diameter of 1½ inches. The jack is made in either of two sizes with the height of the intermediate section above the supporting surface either 11½ inches or 13 inches to accommodate a wide range of different models of two-wheeled motorized vehicles. The length of the tubing 17 is wider than the frame width of the widest known vehicle and typically at least three inches of the tubing 17 will extend beyond the sides of the vehicle frame. The length of tubing 17 is about 17 inches and the length of section 14 is about 32 inches.

From the foregoing it is apparent that the above described jack is of a relatively simple yet durable construction and is highly stable in the load-supporting position. This latter feature is accomplished by having the lever assemblies considerably outside the sides of the vehicle and the cross-support at an intermediate position between the ends of the base support portions so that there is a length of base portion both forwardly and rearwardly of the cross-support to counteract against tipping either forwardly or rearwardly. In this arrangement the cross-support must move up and past a center position before returning to the lowered position.

When working on the vehicle it is advisable to put the vehicle in gear so that the rear wheel acts as a brake. It is further advisable to use a tie-down safety strap the connects at the ends to the cross-support on each side of the vehicle and extends up over the vehicle.

Although the present invention has been described with a certain degree of particularity, it is understood that the present disclosure has been made by way of example and that changes in details of structure may be made without departing from the spirit thereof.

What is claimed is:

1. A lever-action jack comprising:

a single tubular body forming a cross-support and a pair of opposed lever members at opposite ends of said cross-support, each of said lever members including a base portion and a stand portion and having an acute-angle bend between each stand portion and an associated base portion providing a rocking surface along the outside of said acute-angle bend and a right-angle bend between each end of said cross-support and one of said stand portions, each of said stand portions extending at an acute inside angle relative to an associated base portion to locate said cross-support at an intermediate portion back beyond the midpoint between the ends of the associated base portion from the acute-angle bend to counteract loading forces that tend to cause a forward and rear tilting under load; and a handle portion forming an extension of one of said base portions, the perpendicular distance from each of said base portions to said cross-support being less than the combined length of one of said base portions and said handle portion extending from said one base portion to provide a longer lever arm for moving said cross-support means between said lowered and raised support positions and to provide stabilization against forward and rear tilting of the lever means in the raised support position, whereby, in response to a turning force applied to said handle portion and said one base portion, the handle portion and said one base portion provide a force arm with a fulcrum at one end about which said base and stand portions turn in a lever action with said rocking surfaces turning on a supporting surface to move said cross-support from a lowered position with said cross-support and said stand portions resting on a supporting surface to a raised support position with said base portions resting on the supporting surface and said cross-support disposed above said base portions.

2. A lever-action jack as set forth in claim 1 wherein said handle portion is releasably fastened to a free end of either of said base portions.

3. A lever-action jack as set forth in claim 1 wherein said cross-support means has a friction surface for engaging a load being raised and lowered.

4. A lever-action jack as set forth in claim 1 wherein said body is metal.

5. A lever-action jack as set forth in claim 1 wherein each of said lever members is of a corresponding size and shape and is symmetrically arranged relative to the center of said cross-support means.

6. A lever-action jack as set forth in claim 1 wherein each of said stand portions is arranged to position said cross-support relative to said lever members so that in the lifting motion said cross-support means moves to a center position of maximum height and back down slightly so that the load on said cross-support is lifted before the support members return to the lowered position.

7. A lever-action jack as set forth in claim 1 including a brace connected between each of said base portions and said stand portions.

8. A lever-action jack as set forth in claim 3 wherein said friction surface is provided by a length of rubber tubing.

9. The combination of a vehicle having a front wheel, a rear wheel and a frame with a balance point and a jack for raising and supporting said vehicle with one of said wheels on a supporting surface and the other of said wheels raised above the supporting surface, said jack comprising a single tubular body forming a cross-support engaging the frame slightly to one side of the balance point and extending laterally beyond the sides of the vehicle and a pair of oppositely disposed lever members, each of said lever members including a base portion and a stand portion and having an acute-angle bend between each stand portion and an associated base portion providing a rocking surface along the outside of said acute-angle bend and a right-angle bend between each end of said cross-support and one of said stand portions, each of said portions extending at an acute inside angle relative to an associated base portion to locate said cross-support at an intermediate portion back beyond the midpoint between the ends of the associated base portion from the acute-angle bend to counteract loading forces that tend to cause a forward and rear tilting under load; and a handle portion forming an extension of one of said base portions, the perpendicular distance from each of said base portions to said cross-support being less than the combined length of one of said base portions and said handle portion extending from said one base portion to provide a longer lever arm for moving said cross-support means between said lowered and raised support positions and to provide stabilization against forward and rear tilting of the lever means in the raised support position, whereby, in response to a turning force applied to said handle portion and said one base portion, the handle portion and said one base portion provide a force arm with a fulcrum at one end about which said base and stand portions turn in a lever action with said rocking surfaces turning on a supporting surface to move said cross-support from a lowered position with said cross-support and said stand portions resting on a supporting surface to a raised support position with said base portions resting on the supporting surface and said cross-support disposed above said base portions.

10. The combination as set forth in claim 9 wherein the front wheel is raised above a supporting surface and the rear wheel is on the supporting surface.

11. The combination as set forth in claim 9 wherein the rear wheel is raised above a supporting surface and the front wheel is on the supporting surface.

* * * * *